US007827744B2

(12) United States Patent
Wenrick et al.

(10) Patent No.: US 7,827,744 B2
(45) Date of Patent: Nov. 9, 2010

(54) STORM PANEL ASSEMBLY FOR COVERING A WINDOW OR DOOR OPENING

(75) Inventors: Brian A. Wenrick, New Carlisle, OH (US); Jason D. Wenrick, Tipp City, OH (US)

(73) Assignee: Clear Strength USA LLC, Tipp City, OH (US)

( * ) Notice: Subject to any disclaimer, the term of this patent is extended or adjusted under 35 U.S.C. 154(b) by 239 days.

(21) Appl. No.: 12/154,229

(22) Filed: May 21, 2008

(65) Prior Publication Data

US 2009/0288352 A1 Nov. 26, 2009

(51) Int. Cl.
*E06B 3/26* (2006.01)
*E06B 3/68* (2006.01)

(52) U.S. Cl. ..... 52/202; 49/57

(58) Field of Classification Search ..... 52/202, 52/203; 49/463, 465, 50, 57, 61, 62
See application file for complete search history.

(56) References Cited

U.S. PATENT DOCUMENTS

| | | | | |
|---|---|---|---|---|
| 2,878,536 | A | 3/1959 | Becker | |
| 4,333,271 | A | 6/1982 | DePaolo et al. | |
| 4,760,872 | A * | 8/1988 | Hale, Jr. | 160/90 |
| 5,345,716 | A | 9/1994 | Caplan | |
| 5,430,982 | A * | 7/1995 | Bane | 52/202 |
| 5,457,921 | A | 10/1995 | Kostrzecha | |
| 5,487,244 | A * | 1/1996 | Hill | 52/202 |
| 5,620,037 | A * | 4/1997 | Apostolo | 160/118 |
| 5,651,221 | A | 7/1997 | Golen | |
| 5,855,099 | A * | 1/1999 | Hoffman | 52/202 |
| 5,996,292 | A | 12/1999 | Hill et al. | |
| 6,079,168 | A | 6/2000 | Shaver | |
| 6,189,264 | B1 * | 2/2001 | DiVeroli | 49/57 |
| 6,615,555 | B2 | 9/2003 | Madden | |
| 6,974,622 | B2 * | 12/2005 | Wade | 428/182 |
| 2006/0179737 | A1 * | 8/2006 | Trundle | 52/202 |

* cited by examiner

*Primary Examiner*—David Dunn
*Assistant Examiner*—Benjamin Pevarski
(74) *Attorney, Agent, or Firm*—Jacox, Meckstroth & Jenkins

(57) ABSTRACT

A plurality of elongated panels of light transmitting plastics sheet material each have longitudinally extending parallel spaced ribs and longitudinally extending co-planner opposite edge portions. An elongated support member for each panel has a base portion secured to the opposite edge portions of the panel adjacent the upper end portion of the panel and includes a hook portion adapted to engage a hook-shaped support rail mounted on a building over a window or door opening. Each hook portion has end surfaces recessed inwardly from opposite edge surfaces of the panel and provide for overlapping edge portions of adjacent panels. The lower end portion of an outer panel is supported by a sill bracket mounted on the building under the opening and receives a U-shaped track member secured to the panel. The bracket and track member are connected by pull pins located within the ribs of the outer panel.

7 Claims, 2 Drawing Sheets

STORM PANEL ASSEMBLY FOR COVERING A WINDOW OR DOOR OPENING

BACKGROUND OF THE INVENTION

This invention relates to hurricane and storm shutter or panel assemblies including elongated corrugated panels of sheet material which may be light transmitting and which are used for temporarily covering a window or exterior door opening within a building in preparation of heavy storms and impacts such as produced by a hurricane. Examples of such storm shutter or panel assemblies are disclosed in U.S. Pat. Nos. 2,878,536, 4,333,271, 5,345,716, 5,457,921, 5,487,244, 5,651,221, 5,855,099, 5,996,292, 6,079,168, 6,189,264 and 6,615,555. In any such storm shutter or panel assembly, it is desirable for the assembly to be easily and quickly installed over a door or window opening and for the panels to be conveniently and easily removed after the forces of impacts and windloading has ceased.

Once a panel assembly has been installed on a building over an exterior door opening or window opening of the building, it is frequently desirable for the storm panels to be conveniently removed from inside the building through the opening and to be reinstalled from within the building through the opening without the requirement of a ladder, especially on a second floor level or above. In addition to the above desirable features, it is desirable for the installed panel assembly to be architecturally pleasing and to meet all of the building codes on repetitive impacts and cyclic windloading as well as provide for quick removal of a panel from inside the building for escape through the window or door opening if it becomes necessary to vacate the building.

SUMMARY OF THE INVENTION

The present invention is directed to an improved storm panel assembly of the general type disclosed in the above mentioned patents and which provides all of the desirable features mentioned above. In accordance with the illustrated embodiment of the invention, a plurality of elongated panels are formed from the sheet material having a uniform thickness and which is preferably light transmitting. Each panel has longitudinally extending and parallel spaced ribs to form a corrugated cross-sectional configuration and also has co-planar longitudinal opposite edge portions which are also co-planar with a longitudinal center portion.

A support member is mounted on the upper end portion of each panel and is attached to the opposite edge portions and center portion of the panel. The support member includes an upper hook portion having opposite end surfaces recessed laterally inwardly from the longitudinal edge surfaces of the panel. The hook portion of each panel engages a hook-shaped support rail mounted on the building above the opening and provides for overlapping longitudinal edge portions of adjacent panels. The lower edge portion of each outer panel is supported by a sill bracket mounted on the building and projecting under the ribs of an outer panel, and an elongated track member is secured to the lower end portion of an outer panel and receives the support bracket. A pair of pull pins are located within the ribs of the outer panel and secure the track member to the bracket and provide for quick removal of the outer panel for escape from the building.

Other features and advantages of the invention will be apparent from the following description, the accompanying drawings and the appended claims.

DESCRIPTION OF THE ILLUSTRATED EMBODIMENT

Figure 1:
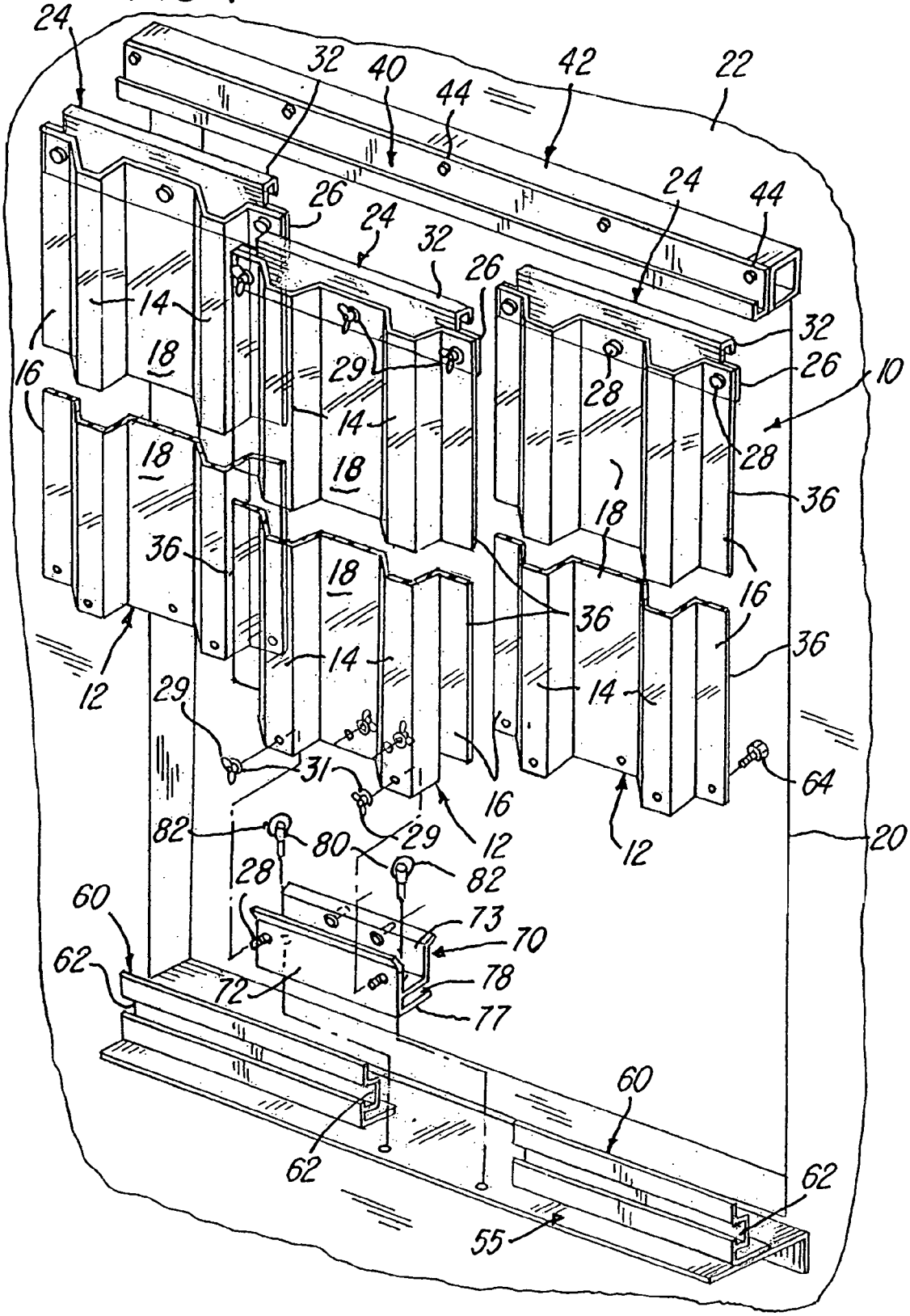
FIG. 1 illustrates a storm panel assembly constructed in accordance with the invention and wherein the storm panels and support members and components are exploded away from a building opening.
Figure 5:
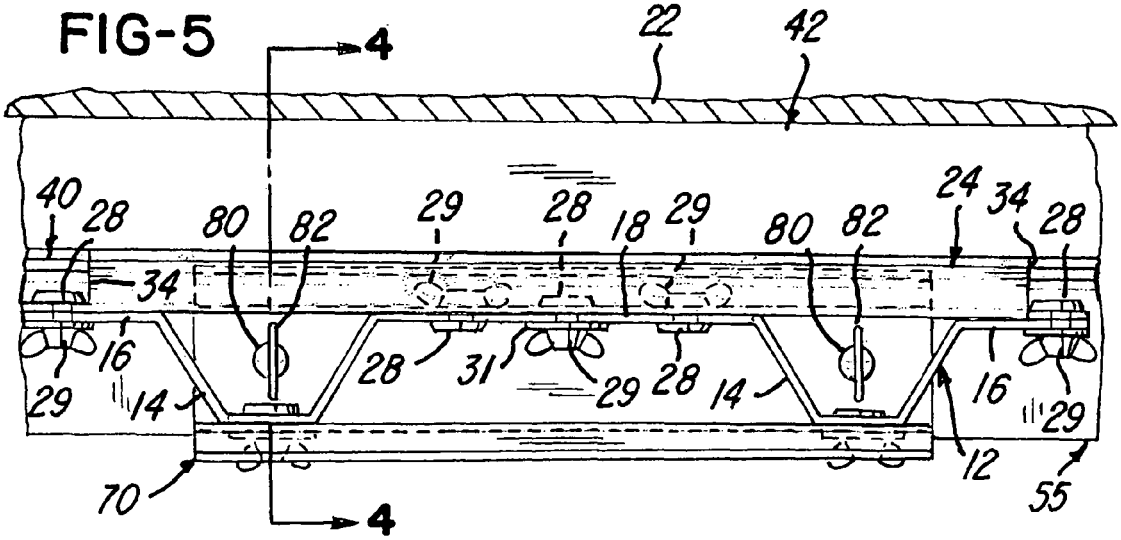
FIG. 5 is a fragmentary top view of an installed outer center panel, taken generally on the line 5-5 of FIG. 2.

Referring to FIG. 1, a storm panel assembly 10 includes a plurality of elongated panels 12 each of which is vacuum-formed from a sheet of substantially rigid light transmitting or clear transparent plastics material such as polycarbonate. Each of the panels 12 is formed with a pair of parallel spaced and longitudinally extending ribs 14 which have a trapezoid cross-sectional configuration, as shown in FIG. 5, and project from longitudinally extending co-planar flat edge portions 16 and a flat center portion 18 which is co-planar with the edge portions 16. The panel assembly 10 is constructed to cover a door or window opening 20 within a residence or building 22 and is used to protect the window or door and the contents of the building during a heavy windstorm and impacts such as occur during a hurricane.

An elongated support rail or member 24 is attached to the upper end portion of each panel 12 and is formed from an extrusion of rigid material such as aluminum. Each support member 24 includes a longitudinally extending flat base portion 26 which is secured to the upper end portion of the panel 12 by a set of flat head threaded fasteners or screws 28 (FIG. 3) and wing nuts 29 on top of washers 31. Each support rail or member 24 also includes a longitudinally extending and upwardly projecting hook portion 32 which has an inverted J-shaped cross-sectional configuration. As shown in FIG. 1, the opposite end surfaces 34 of the hook portion 32 of each support member 24 are recessed laterally inwardly from the longitudinal edge surfaces 36 of the attached panel 12.

Figure 3:
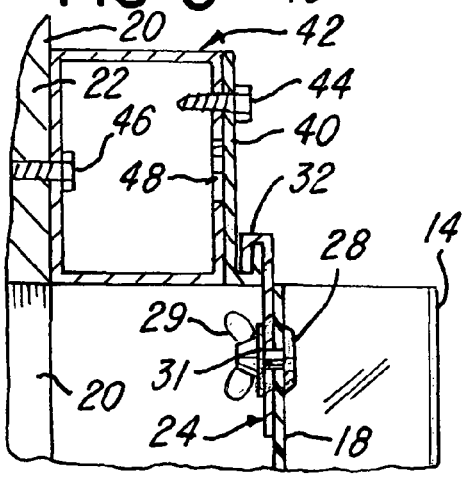
FIG. 3 is a fragmentary vertical section taken generally on the line 3-3 of FIG. 2.

As shown in FIG. 3, the support members 24 on the panels 12 hook onto an elongated J-shaped header track or rail 40 which is secured to a spacer member or tube 42 (FIG. 3) by longitudinally spaced self-tapping screws 44. The spacer member or tube 42 is attached to the building 22 by longitudinally spaced anchor bolts 46. The spacer tube 42 has longitudinally spaced clearance holes 48 which are aligned with the holes for the bolts 46 for securing the bolts 46 to the building with a socket wrench extending through the holes 48 which are covered by the rail 40.

Figure 2:
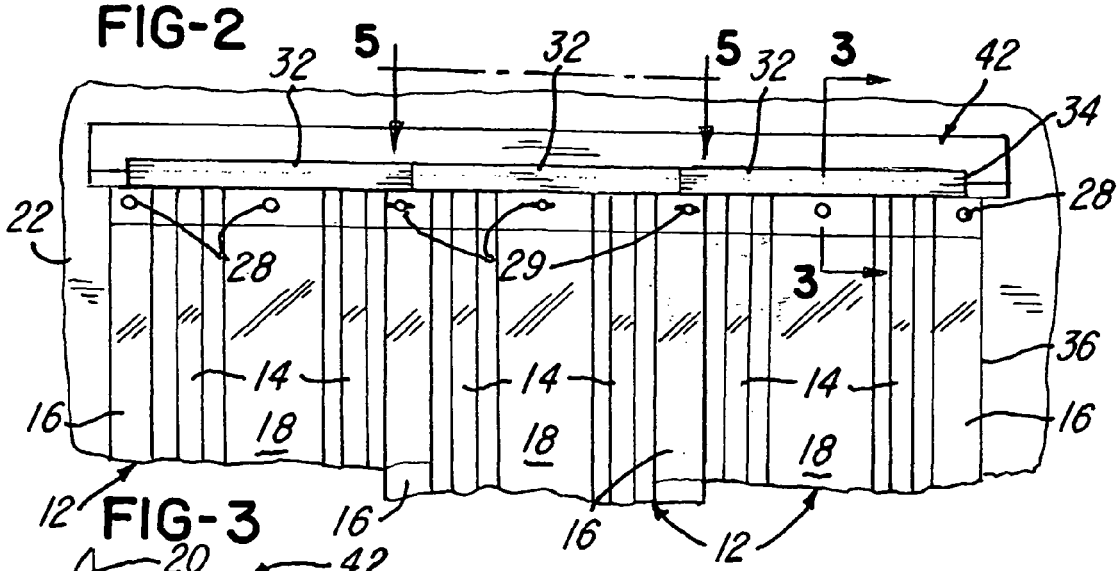
FIG. 2 is an elevational view of an upper portion of the panel assembly shown in FIG. 1 after being installed.

Referring to FIG. 1, three of the panels 12 are arranged so that two inner side panels 12 hook onto the rail 40 first, and then an outer center panel 12 hooks onto the rail 40 with the co-planar edge portions 16 of the center panel and the attached end portions of the support member 24 overlapping the panel edge portions 16 and the attached end portions of the support member 24 of the adjacent side panels 12, as shown in FIG. 2. As also shown in FIGS. 1 and 2, the recessed end surfaces 34 of the hook portions 32 provide for overlapping the edge portions 16 of the panels 12 and for overlapping of the opposite end portions of the base portion 26 attached to the panel edge portions 16. Also, the flat head portions of the threaded fasteners or screws 28 face inwardly on the center panel 12 and outwardly on the adjacent side panels 12 to provide for overlapping the edge portions 16 of the panels. The hook portion 32 of the support member 24 on the center panel has sufficient depth to provide for overlapping the panel edge portions 16.

Figure 4:
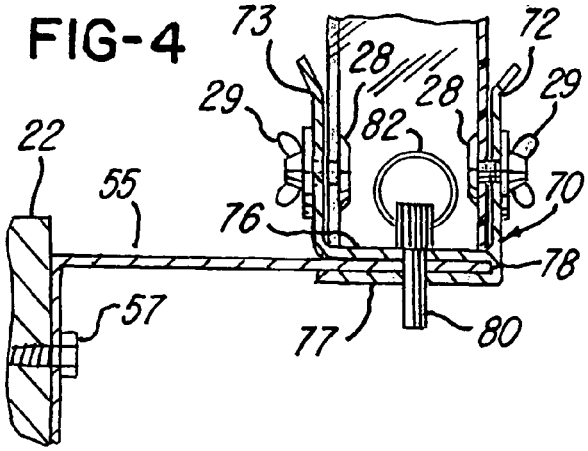
FIG. 4 is a fragmentary vertical section taken generally on the line 4-4 of FIG. 5.

Referring to FIGS. 1, 4 and 5, a horizontal right angle sill bracket 55 is attached to the outer surface of the building 22 below the opening 20 by a series of longitudinally spaced anchor bolts 57, and the bracket 55 extends under each of the panels 12. The lower end portion of each of the inner side panels 12 is attached to the bracket 55 by a corresponding conventional angle track 60, commonly referred to as a reverse F-track. The track 60 has a longitudinally extending under-cut groove or recess 62 which receives the square or hex head of a set of three bolts 64 which extend through corresponding holes within the lower end portions of the panel edge portions 16 and center portion 18 of each inner side panel 12. The outer end portions of the bolt 64 receive corresponding flat washers 31 and wing nuts 29 to secure the lower end portion of each side panel 12 to the corresponding angle bracket 60 which is attached by bolts (not shown) to the sill bracket 55.

As also shown in FIGS. 1, 4 and 5, a lower end portion of the outer center panel 12 receives an extruded aluminum elongated track member 70 having parallel spaced outer flange 72 and inner flange 73. The outer flange 72 is secured to the ribs 14 by flat head bolts 28, washers 31 and wing nuts 29. The inner flange 73 is secured to the center portion 18 of the center panel 12 also by a pair of flat head bolts 28, washers 31 and wing nuts 29. The lower end portion of the track member 20 has parallel spaced and integrally connected walls 76 and 77 which define a slot or groove 78 for receiving the outer end portion of the sill bracket 50. The track member 70 is rigidly secured or connected to the sill bracket 55 by a pair of pull pins 80 which are located within the ribs 14, as shown in FIG. 5. Each of the pull pins 80 has an upper ring 82 which is adapted to be gripped from inside the building through the opening 20 when it is desired to pull the pins 80 and release the track member 70 from the sill bracket 55.

From the drawings and the above description, it is apparent that a storm panel assembly constructed and installed in accordance with the invention, provides all of the desirable features and advantages mentioned above. More specifically, after the top support rail 40 and the lower sill bracket 55 are attached to the outer surface of the building above and below the window or door opening 20, the panels 12 may be quickly and conveniently attached or hooked onto the rail 40 with the edge portions 16 of the panels overlapping so that the overlapping edge portions 16 of the panels reinforce the assembly. Furthermore, when a set of three panels 12 are used to cover an opening 20, as shown in FIGS. 1 & 2, the outer center panel 12 is positively connected to the sill bracket 55 by the track member 70 and the pull pins 82. As a result, the center panel 12 may be conveniently and quickly installed on the header rail 40 and sill bracket 55 from inside the building through the opening 20 simply by hooking on the top portion of the center panel, sliding the sill bracket 55 into the groove 78, and inserting the pull pins 82.

In the event it is desired to remove the center panel quickly from inside the building and through the opening 20, the pull pins 82 are pulled upwardly, and the lower end portion of the center panel 12 is pushed outwardly from the sill bracket 55 and unhooked from the rail 40 so that the center panel may be completely removed and placed outside or inside the building. If it is desired to have more or all of the panels 12 be installed and/or removable through the opening 20 from inside the building, a separate track member 70 may be attached to the lower end portion of each of the panels 12 and used in place of the angle tracks 60. Thus after the header rail 40 and sill bracket 55 are once installed above and below a window on a floor above the ground floor, all of the panels 12 may be conveniently installed and removed from inside the building through the window opening 20 by attaching a track member 70 to the lower end portion of each panel 12.

While the form of storm panel assembly herein described constitutes a preferred embodiment of the invention, it is to be understood that the invention is not limited to this precise form of storm panel assembly, and that changes made therein without departing from the scope and spirit of the invention as defined in the appended claims.

What is claimed is:

1. A storm panel assembly adapted to cover a window or door opening in a building, said panel assembly comprising a plurality of elongated panels each having a substantially uniform thickness and including at least one inner panel and at least one outer panel relative to the building, each of said panels having a plurality of longitudinally extending and parallel spaced ribs forming a corrugated cross-sectional configuration, each of said panels having an upper end portion and a lower end portion and longitudinally extending co-planar opposite edge portions, a support member mounted on said upper end portion of each said panel and having a lower base portion attached to each of said opposite edge portions of said panel, each said support member including an upper hook portion having opposite end surfaces recessed laterally inwardly from longitudinal edge surfaces of said opposite edge portions of said panel to provide for overlapping said longitudinal edge portions of adjacent said panels, said upper hook portion of each said support member on each said panel adapted to engage a hook-shaped support rail mounted on the building, at least one of said longitudinal edge portions of said outer panel overlap one of said edge portions of said inner panel, said lower end portion of said outer panel is supported by a bracket adapted to be mounted on the building and projecting under said ribs of said outer panel, an elongated track member including a U-shaped portion receiving said lower end portion of said outer panel and secured by fasteners to said ribs and a flat portion of said panel between said ribs, and a set of pull pins located within said ribs of said outer panel and securing said track member to said bracket to provide for rapidly removing said outer panel through the opening from within the building.

2. A storm panel assembly adapted to cover a window or door opening in a building, said panel assembly comprising a plurality of elongated panels each having a substantially uniform thickness and including at least one inner panel and at least one outer panel relative to the building, each of said panels having a plurality of longitudinally extending and parallel spaced ribs forming a corrugated cross-sectional configuration, each of said panels having an upper end portion and a lower end portion and longitudinally extending co-planar opposite edge portions, a support member mounted on said upper end portion of each said panel and having a lower base portion attached to each of said opposite edge portions of said panel, each said support member including an upper hook portion having opposite end surfaces recessed laterally inwardly from longitudinal edge surfaces of said opposite edge portions of said panel to provide for overlapping said longitudinal edge portions of adjacent said panels, said upper hook portion of each said support member on each said panel adapted to engage a hook-shaped support rail mounted on the building, at least one of said longitudinal edge portions of said outer panel overlap one of said edge portions of said inner panel, said lower end portion of said inner panel being supported by a bracket adapted to be mounted on the building and projecting under said ribs of said inner panel, an elongated track member connected to said bracket and having a longitudinally extending undercut groove, and a threaded fastener having a head portion within said undercut groove and projecting through a hole within an adjacent said edge portion of said inner panel.

3. A storm panel assembly adapted to cover a window or door opening in a building, said panel assembly comprising a plurality of elongated panels each having a substantially uniform thickness and including at least one inner panel and at least one outer panel relative to the building, each of said panels having a plurality of longitudinally extending and parallel spaced ribs with adjacent ribs integrally connected by a longitudinally extending rib connecting portion to provide said panel with a corrugated cross-sectional configuration, each of said panels having an upper end portion and a lower end portion and longitudinally extending opposite edge portions co-planar with said rib connecting portion, an elongated support rail extending laterally across said upper end portion of each said panel and having an upper hook portion and a lower base portion, said lower base portion of each said support rail attached to the co-planar said opposite edge portions of said panel and the co-planar said rib connecting portion of said panel, each said elongated support rail having an end surface recessed laterally inwardly from a longitudinal edge of an adjacent said edge portion of said panel and providing for overlapping said longitudinal edge portions of said inner panel and said outer panel, said upper hook portion of each said support rail on each said panel adapted to engage an elongated support member mounted on the building, and at least one of said longitudinal edge portions of said outer panel overlap one of said longitudinal edge portions of said inner panel.

4. A storm panel assembly as defined in claim 3 and including a support bracket for said lower end portion of said outer panel and adapted to be mounted on the building, said bracket including an outwardly projecting horizontal flange portion, a track member secured to said lower end portion of said outer panel and defining a horizontal groove receiving said flange portion of said bracket, and at least one vertical pull pin located within one of said ribs of said outer panel and extending through vertically aligned holes within said track member and said flange portion to provide for rapidly removing said outer panel by moving said outer panel outwardly away from the opening in the building.

5. A storm panel assembly as defined in claim 3 wherein said lower end portion of said outer panel is supported by a bracket adapted to be mounted on the building and projecting under said ribs of said outer panel, an elongated U-shaped track member receiving said lower end portion of said outer panel and secured by fasteners to said ribs and said rib connecting portion between said ribs, and a set of vertical pull pins located within said ribs of said outer panel and securing said track member to said bracket to provide for rapidly removing said outer panel by moving said outer panel outwardly away from the opening in the building.

6. A storm panel assembly as defined in claim 3 and including a second said inner panel, and each said elongated support rail has opposite end surfaces recessed laterally inwardly from opposite longitudinal edges of the corresponding said panel.

7. A storm panel assembly as defined in claim 3 wherein said lower end portion of said inner panel is supported by a bracket adapted to be mounted on the building and projecting under said ribs of said inner panel, an elongated track member connected to said bracket and having a longitudinally extending undercut groove, and a threaded fastener having a head portion within said undercut groove and projecting through a hole within an adjacent said edge portion of said inner panel.

* * * * *